United States Patent [19]

Hibino

[11] Patent Number: 4,484,497

[45] Date of Patent: Nov. 27, 1984

[54] FUEL CUT-OFF SYSTEM FOR AN ENGINE COUPLED TO AN AUTOMATIC POWER TRANSMISSION WITH A LOCKUP DEVICE

[75] Inventor: Masahiro Hibino, Tokyo, Japan

[73] Assignee: Nissan Motor Company, Limited, Yokohama, Japan

[21] Appl. No.: 541,039

[22] Filed: Oct. 12, 1983

[30] Foreign Application Priority Data

Oct. 14, 1982 [JP] Japan ..... 57-180364

[51] Int. Cl.[3] ..... F02D 5/00

[52] U.S. Cl. ..... 74/859; 74/872; 123/325; 123/333

[58] Field of Search ..... 123/325, 332, 333, 340, 123/320; 74/856, 859, 860, 870, 871, 872, 873

[56] References Cited

U.S. PATENT DOCUMENTS

| | | | |
|---|---|---|---|
| 4,226,141 | 10/1980 | Espenchied | 74/859 |
| 4,391,243 | 7/1983 | Bessho | 123/325 |
| 4,416,230 | 11/1983 | Katayose et al. | 123/325 |
| 4,434,759 | 3/1984 | Iezuka et al. | 123/325 |

FOREIGN PATENT DOCUMENTS

| | | | |
|---|---|---|---|
| 57-37142 | 3/1982 | Japan | 74/859 |

*Primary Examiner*—William A. Cuchlinski, Jr.

*Attorney, Agent, or Firm*—Schwartz, Jeffery, Schwaab, Mack, Blumenthal & Koch

[57] ABSTRACT

An engine is coupled to an automatic power transmission having a lockup device. The lockup device is in an operative position when the speed of the engine is higher than a preset lockup reference level, and is in a rest position when the engine speed is not higher than the lockup reference level. A deceleration sensor detects when the engine is required to decelerate. A speed sensor detects the speed of the engine. A fuel-control device is associated with the deceleration sensor and the speed sensor to supply fuel to the engine when the engine is required to decelerate and the engine speed is lower than an adjustable fuel-supply control level. The fuel-control device also serves to interrupt the supply of fuel to the engine when the engine is required to decelerate and the engine speed is not lower than the fuel-supply control level. When the lockup device is in the rest position, the fuel-supply control level is equal to a first preset value. When the lockup device is in the operative position, the fuel-supply control level is equal to a second preset value greater than both of the first value and the lockup reference level.

5 Claims, 5 Drawing Figures

FUEL CUT-OFF SYSTEM FOR AN ENGINE COUPLED TO AN AUTOMATIC POWER TRANSMISSION WITH A LOCKUP DEVICE

BACKGROUND OF THE INVENTION

This invention relates to a fuel cut-off system for an engine coupled to an automatic power transmission with a lockup device.

It is well-known to cut off or interrupt the supply of fuel to an automotive engine when the engine is required to reduce its speed or when the engine is decelerating. The fuel cut-off is to improve fuel economy and reduce undesirable emissions. Specifically, during deceleration at engine speeds above a reference level, the fuel cut-off continues until the engine speed drops to the reference level. When the engine speed reaches the reference level, the fuel supply is recommenced to prevent the engine from stalling.

Interruption and recommencement of fuel supply causes considerable changes in the torque output of the engine. In addition, the torque output of most engines inevitably fluctuates even when the engine operates at a constant speed. These inevitable torque fluctuations are smaller than the torque changes due to interruption and recommencement of fuel supply. In the case of automotive vehicles, such engine torque changes and fluctuations cause vibrations of the vehicle bodies. The higher the engine speed, the weaker or less annoying the vibrations of the vehicle bodies resulting from such engine torque changes and fluctuations.

Some automotive automatic power transmissions including torque converters have lockup devices which act to mechanically couple the crankshaft of the engines to the output shaft of the transmissions. Specifically, when the lockup device assumes its rest position, the crankshaft of the engine and the output shaft of the transmission are coupled via fluid in the torque converter in normal operation. When the lockup device assumes its operative position, the crankshaft of the engine and the output shaft of the transmission are coupled by means of a completely mechanical connection, not via fluid in the torque converter, and thus the torque converter is disabled or locked up. Under these lockup conditions, since the loss of power transmission occurring in the normally-operating torque converter is avoided, fuel economy is improved.

When such a lockup device assumes its rest position, the torque converter has the additional function of absorbing variations in the torque output of the engines and thus smoothing the engine torque output. Such an additional function disappears when the lockup device assumes its operative position.

Usually, the lockup device is designed to assume its operative position when the engine is operating at intermediate and high speeds above a lockup reference value, where the vibrations of the vehicle bodies resulting from the inevitable engine torque fluctuations are relatively weak. The lockup device assumes its rest position when the engine is operating at low speeds below the lockup reference value.

In the case of an automotive engine provided with a fuel cut-off device and coupled to an automatic power transmission with a lockup device, relatively great vibrations may occur during interruption and recommencement of fuel supply if the lockup device is in its operative position and the engine speed is immediately above the lockup reference value.

SUMMARY OF THE INVENTION

It is an object of this invention to provide a fuel cut-off system for an automotive engine coupled to an automatic power transmission with a lockup device which effectively prevents vibrations of the automotive vehicle resulting from interruption and recommencement of fuel supply.

In accordance with this invention, a fuel cut-off system is applied to an engine coupled to an automatic power transmission having a lockup device. The lockup device is in an operative position when the speed of the engine is higher than a preset lockup reference level, and is in a rest position when the engine speed is not higher than the lockup reference level. The fuel cut-off system includes a deceleration sensor acting to detect when the engine is required to decelerate, and a speed sensor acting to detect the speed of the engine. A fuel-control device is associated with the deceleration sensor and the speed sensor to supply fuel to the engine when the engine is required to decelerate and the engine speed is lower than an adjustable fuel-supply control level. The fuel-control device also serves to interrupt the supply of fuel to the engine when the engine is required to decelerate and the engine speed is not lower than the fuel-supply control level. When the lockup device is in the rest position, the fuel-supply control level is equal to a first preset value. When the lockup device is in the operative position, the fuel-supply control level is equal to a second preset value greater than both of the first value and the lockup reference level.

The above and other objects, features and advantages of this invention will be apparent from the following description of preferred embodiments thereof, taken in conjunction with the drawings.

BRIEF DESCRIPTION OF THE DRAWINGS

Like elements and signals are denoted by same reference numerals and characters throughout the drawings.

DESCRIPTION OF THE PREFERRED EMBODIMENTS

Figure 1:
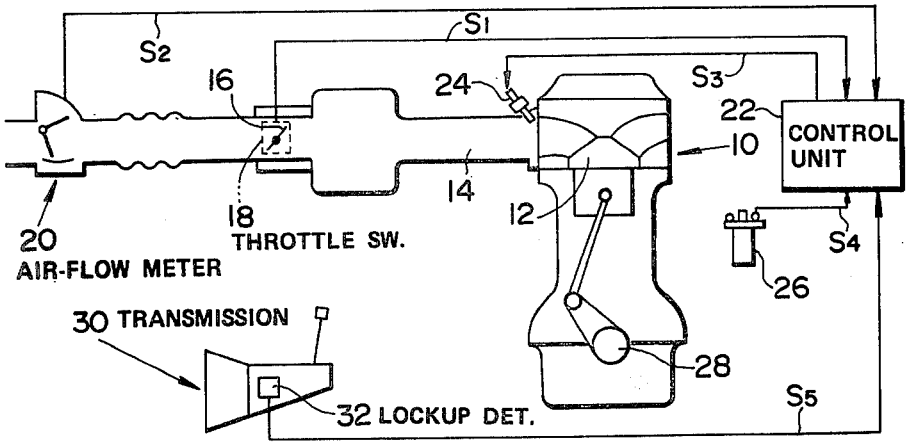
FIG. 1 is a diagram of a fuel cut-off system for an engine coupled to an automatic power transmission with a lockup device according to a first embodiment of this invention.

With reference to FIG. 1 diagrammatically illustrating a first embodiment of this invention, an automotive internal combustion engine 10 has combustion chambers 12 (only one of which is shown) and an air intake passage 14 leading to the combustion chambers 12 to conduct air to the combustion chambers 12. A throttle valve 16 is disposed in the air passage 14 to controllably determine the rate of air flow into the combustion chambers 12. A known throttle switch 18 is associated with the throttle valve 16 to sense whether or not the throttle valve 16 is fully closed. The throttle switch 18 generates a digital signal $S_1$ indicative whether or not the throttle valve 16 is in its fully-closed position. In general, when the engine 10 is required to decelerate, the throttle valve 16 is fully closed. Therefore, the throttle signal $S_1$ represents the requirement for deceleration of the engine 10.

A known air-flow meter 20 is disposed in the air passage 14 upstream of the throttle valve 16 to monitor the rate of air flow into the combustion chambers 12. The meter 20 generates an analog signal $S_2$ indicative of the rate of air flow into the combustion chambers 12. A control unit 22 is electrically connected to the meter 20 to receive the air-flow rate signal $S_2$. Electrically-driven fuel injection valve or valves 24 are disposed in the air passage 14 downstream of the throttle valve 16 to controllably inject fuel into the air passage 14. The fuel injection valves 24 are electrically connected to the control unit 22 to receive a fuel injection pulse signal $S_3$ which is designed to drive the fuel injection valves 24 and which is generated by the control unit 22 in response to the air-flow rate signal $S_2$. Specifically, the duty cycle of the fuel injection signal $S_3$ determines the rate of fuel injection. The control unit 22 adjusts the rate of fuel injection by controlling the duty cycle of the fuel injection signal $S_3$ in response to the rate of air flow derived from the signal $S_2$ so that the air-to-fuel ratio of the resulting air/fuel mixture will be regulated to an optimal level.

An ignition coil 26 outputs an ignition pulse signal $S_4$ having a frequency proportional to the engine speed. Specifically, the ignition signal $S_4$ appears at the negative terminal of the primary winding of the ignition coil 26. The control unit 22 is electrically connected to the ignition coil 26 to receive the ignition signal $S_4$. The control unit 22 adjusts the fuel injection signal $S_3$ on the basis of the ignition signal $S_4$ so that the frequency of the fuel injection signal $S_3$ will be proportional to the engine speed. In view of this fact, the control unit 22 adjusts the pulse width of the fuel injection signal $S_3$ in response to the air-flow rate and also the engine speed to realize the control of the duty cycle of the fuel injection signal $S_3$ in accordance with the air-flow rate.

The engine 10 has a crankshaft 28 coupled to an automatic power transmission 30 including a torque converter. The power transmission 30 has an output shaft connected in turn to automotive vehicle wheels (not shown). The power transmission 30 is equipped with a lockup device which can assume either an operative position or a rest position. When assuming its operative position, the lockup device mechanically couples the engine crankshaft 28 and the output shaft of the transmission 30 and thus disables the torque converter. When assuming its rest position, the lockup device enables normal operation of the torque converter. A lockup control circuit (not shown) sets the lockup device in its operative position under a predetermined range of conditions of the engine speed, the automotive vehicle speed, the degree of opening of the throttle valve 16 or the intake manifold vacuum, i.e., the vacuum developing in the air passage 12 downstream of the throttle valve 16, the transmission gear position derived via the ignition coil 26 and known sensors (not-shown). Specifically, the lockup device can assume its operative position at engine speeds above a lockup reference level $N_L$. The lockup device remains in its rest position at engine speeds below the lockup reference level $N_L$. Preferably, the lockup reference level $N_L$ is 2,000 r.p.m.

A lockup detector 32 is associated with the lockup device to sense the position of the lockup device. The lockup detector 32 generates a digital signal $S_5$ indicative of whether the lockup device is in its operative position or rest position. The control unit 22 is electrically connected to the lockup detector 32 to receive the lockup signal $S_5$.

Under predetermined conditions of the throttle valve position, the engine speed, and the lockup device position derived from the signals $S_1$, $S_4$, and $S_5$, the control unit 22 sets the duty cycle of the fuel injection signal $S_3$ to zero to cut off or interrupt the supply of fuel to the engine 10 independently of the air-flow rate derived from the signal $S_2$. Specifically, the control unit 22 performs the fuel cut-off when the throttle valve 16 is in the fully-closed position at engine speeds above a first reference level or fuel cut-off level Nc, that is, when the engine is clearly required to decelerate. The control unit 22 enables the supply of fuel when the throttle valve 16 is in the fully-closed position at engine speeds below a second reference level or fuel-supply recovery level Nr. While the throttle valve 16 remains fully closed to decrease the engine speed from a certain value above the fuel cut-off level Nc, the fuel cut-off continues until the engine speed reaches the fuel-supply recovery level Nr. In this case, when the engine speed reaches the fuel-supply recovery level Nr, the supply of fuel is recommenced to prevent the engine from stalling. As the engine speed increases from a certain value below the fuel-supply recovery level Nr while the throttle valve 16 remains fully closed, the fuel supply continues until the engine speed reaches the fuel cut-off level Nc. In this case, when the engine speed reaches the fuel cut-off level Nc, the supply of fuel is interrupted. Such a condition can occur when the automotive vehicle is running along a down slope. It should be noted that the supply of fuel is always maintained when the throttle valve 16 remains out of its fully-closed position.

The control unit 22 changes the fuel cut-off level Nc and also the fuel-supply recovery level Nr on the basis of the position of the lockup device derived from the signal $S_5$. The fuel cut-off level Nc is changeable between a lower value $Nc_1$ and a higher value $Nc_2$. Likewise, the fuel-supply recovery level Nr is changeable between a lower value $Nr_1$ and a higher value $Nr_2$. When the lockup device is in its rest position, the control unit 22 selects the lower values $Nc_1$ and $Nr_1$. When the lockup device is in its operative position, the control unit 22 selects the higher values $Nc_2$ and $Nr_2$. Generally, the lower values $Nc_1$ and $Nr_1$ are lower than the lockup reference level $N_L$, and the higher values $Nc_2$ and $Nr_2$ are considerably greater than the lockup reference level $N_L$. In the case of a lockup reference level $N_L$ equal to 2,000 r.p.m., the lower values $Nc_1$ and $Nr_1$ are preferably 1,400 r.p.m. and 1,200 r.p.m. respectively and the higher values $Nc_2$ and $Nr_2$ are preferably 3,000 r.p.m. and 2,800 r.p.m. respectively.

Since the fuel-supply recovery higher value $Nr_2$ is considerably greater than the lockup reference level $N_L$, the fuel cut-off remains disabled and thus the fuel supply continues throughout a relatively wide range of engine speeds from the lockup reference level $N_L$ to the fuel-supply recovery higher value $Nr_2$ when the lockup device is in its operative position. If the fuel cut-off occurred at engine speeds only slightly above the lockup reference level $N_L$ when the lockup device was in its operative position, the fuel cut-off would cause severe vibrations of the automotive vehicle. It should be noted that the torque converter will not absorb variations in the engine torque output when the lockup device is in its operative position, and that the higher the engine speed, the less severe the vibrations of the automotive vehicle resulting from variations in the engine torque output. These severe vibrations of the automotive vehicle are effectively avoided by preventing fuel cut-off in the previously-mentioned wide range of engine speeds just above the lockup reference level $N_L$.

The control unit 22 includes a digital microcomputer system having an input/output (I/O) circuit, a central processing unit (CPU) connected to the I/O circuit, a read-only memory (ROM) connected to the CPU, and a random-access memory (RAM) connected to the CPU. The control unit 22 operates in accordance with a program stored in the ROM. The control unit 22 receives and outputs the signals $S_1$, $S_2$, $S_3$, $S_4$, and $S_5$ via the I/O circuit. The I/O circuit includes an analog-to-digital converter which serves to convert the analog air-flow rate signal $S_2$ into a corresponding digital signal. The I/O circuit includes a frequency detector which monitors the frequency of the ignition signals $S_4$ representing the engine speed and which generates a digital signal indicative of the engine speed. The I/O circuit includes a pulse-width modulator which is controlled via a digital input signal to adjustably determine the pulse-width of the fuel injection signal $S_3$.

The lockup device includes a hydraulically-drivable lockup clutch member or piston. The lockup device has an electrically-powered ON-OFF solenoid valve which controllably adjusts the hydraulic pressure applied to the lockup clutch member. When the solenoid valve is electrically energized and de-energized, the lockup clutch member changes between its rest and operative positions in which the lockup device assumes its rest and operative positions respectively. The lockup detector 32 includes a relay which has a control winding and a switch operable via electrical energization and de-energization of the control winding. The relay winding is electrically connected in series with the solenoid valve to an electric power source, so that the relay winding is electrically energized and de-energized when the solenoid valve is electrically energized and de-energized respectively. As a result, the relay switch is actuated in accordance with the position of the lockup device. The relay switch is connected to the control unit 22 to apply the signal $S_5$ indicative of the position of the lockup device to the control unit 22.

Figure 2:
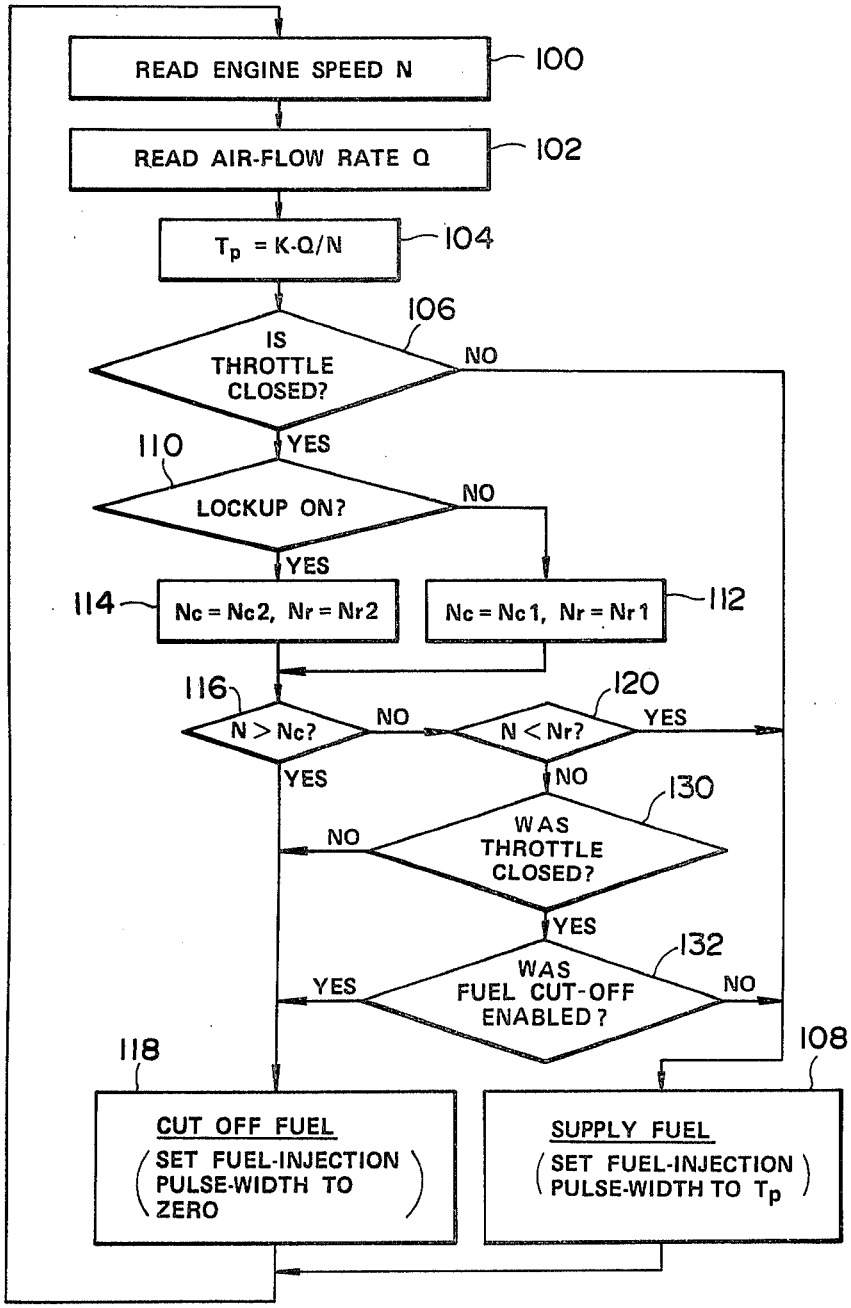
FIG. 2 is a flowchart of operation of the control unit of FIG. 1.

The control unit 22 operates in accordance with a program stored in the ROM of the control unit 22. FIG. 2 is a flowchart of operation of the control unit 22. In a first step 100, the control unit 22 reads the current value N of the engine speed derived from the ignition signal $S_4$. In a step 102 subsequent to the step 100, the control unit 22 reads the current value Q of the air-flow rate derived from the signal $S_2$. After the step 102, operation of the control unit 22 proceeds to a step 104 in which the control unit 22 calculates a desired value Tp of the pulse width of the fuel injection signal $S_3$ on the basis of the engine speed value N and the air-flow rate value Q. The desired pulse-width value Tp preferably equals KQ/N, where K is a preset constant. The desired pulse-width value Tp may be corrected in accordance with the temperature of engine coolant and other engine operating conditions.

In a step 106 subsequent to the step 104, the control unit 22 determines whether or not the throttle valve 16 is in its fully-closed position in accordance with the throttle signal $S_1$. When the throttle valve 16 is not in its fully-closed position, operation of the control unit 22 proceeds to a step 108. When the throttle valve 16 is in its fully-closed position, operation of the control unit 22 proceeds to a step 110. In the step 108, the control unit 22 sets the actual pulse-width of the fuel injection signal $S_3$ equal to the desired pulse-width value Tp determined in the previous step 104. After the step 108, operation of the control unit 22 returns to the first step 100. As a result, while the throttle valve 16 remains out of its fully-closed position, the supply of fuel to the engine is maintained.

In the step 110, the control unit 22 determines whether the lockup device is in its rest position or operative position in accordance with the lockup signal $S_5$. When the lockup device is in its rest position, operation of the control unit 22 proceeds to a step 112. When the lockup device is in its operative position, operation of the control unit 22 proceeds to a step 114. In the step 112, the control unit 22 sets the fuel cut-off level Nc and the fuel-supply recovery level Nr equal to the lower values $Nc_1$ and $Nr_1$ respectively. In the step 114, the control unit 22 sets the fuel cut-off level Nc and the fuel-supply recovery level Nr equal to the higher values $Nc_2$ and $Nr_2$ respectively. In this way, the fuel cut-off level Nc and the fuel-supply recovery level Nr depend on the position of the lockup device. The lower values $Nc_1$ and $Nr_1$, and the higher values $Nc_2$ and $Nr_2$ are stored in the ROM of the control unit 22.

After the steps 112 and 114, operation of the control unit 22 proceeds to a step 116 in which the control unit 22 determines whether or not the engine speed value N is higher than the fuel cut-off level Nc. When the engine speed value N is higher than the fuel cut-off level Nc, operation of the control unit 22 proceeds to a step 118 in which the control unit 22 sets the actual pulse-width of the fuel injection signal $S_3$ equal to zero to cut off or interrupt the supply of fuel to the engine 10. After the step 118, operation of the control unit 22 returns to the first step 100. As a result, the fuel cut-off is performed when the throttle valve 16 is in its fully-closed position and the engine speed value N is higher than the fuel cut-off level Nc. In this case, the fuel cut-off level Nc changes from the lower value $Nc_1$ to the higher value $Nc_2$ when the lockup device shifts from its rest position to its operative position.

When the engine speed value N is not higher than the fuel cut-off level Nc, operation of the control unit 22 proceeds from the step 116 to a step 120 in which the control unit 22 determines whether or not the engine speed value N is lower than the fuel-supply recovery level Nr. When the engine speed value N is lower than the fuel-supply recovery level Nr, operation of the control unit 22 proceeds to the fuel-supply enabling step 108. As a result, the fuel supply is performed when the throttle valve 16 is in its fully-closed position and the engine speed value N is lower than the fuel-supply recovery level Nr. In this case, the fuel-supply recovery level Nr changes from the lower value $Nr_1$ to the higher value $Nr_2$ when the lockup device shifts from its rest position to its operative position.

When the engine speed value N is not lower than the fuel-supply recovery level Nr, operation of the control unit 22 proceeds from the step 120 to a step 130 in which the control unit 22 determines whether or not the throttle valve 16 was in its fully-closed position at the time of the preceding execution of the flowchart. When the throttle valve 16 was in its fully-closed position, operation of the control unit 22 proceeds to a step 132. When the throttle valve 16 was not in its fully-closed position, operation of the control unit 22 proceeds to the fuel-supply interrupting step 118.

In the step 132, the control unit 22 determines whether or not fuel cut-off was performed at the time of the preceding execution of the flowchart. When the fuel cut-off was performed, operation of the control unit 22 proceeds to the fuel-supply interrupting step 118. When the fuel cut-off was not performed, operation of the control unit 22 proceeds to the fuel-supply enabling step 108.

The steps 130 and 132 cooperate to enable the fuel cut-off in the engine speed range between the levels Nr and Nc when the engine speed has dropped into that engine speed range, provided that the throttle valve 16 remains fully closed. Also, the steps 130 and 132 cooperate to maintain fuel supply in that engine speed range when the engine speed has risen into that engine speed range, although the throttle valve 16 remains fully closed.

It should be understood that the speed of the automotive vehicle may be used in place of the engine speed in this embodiment of this invention.

Figure 3:
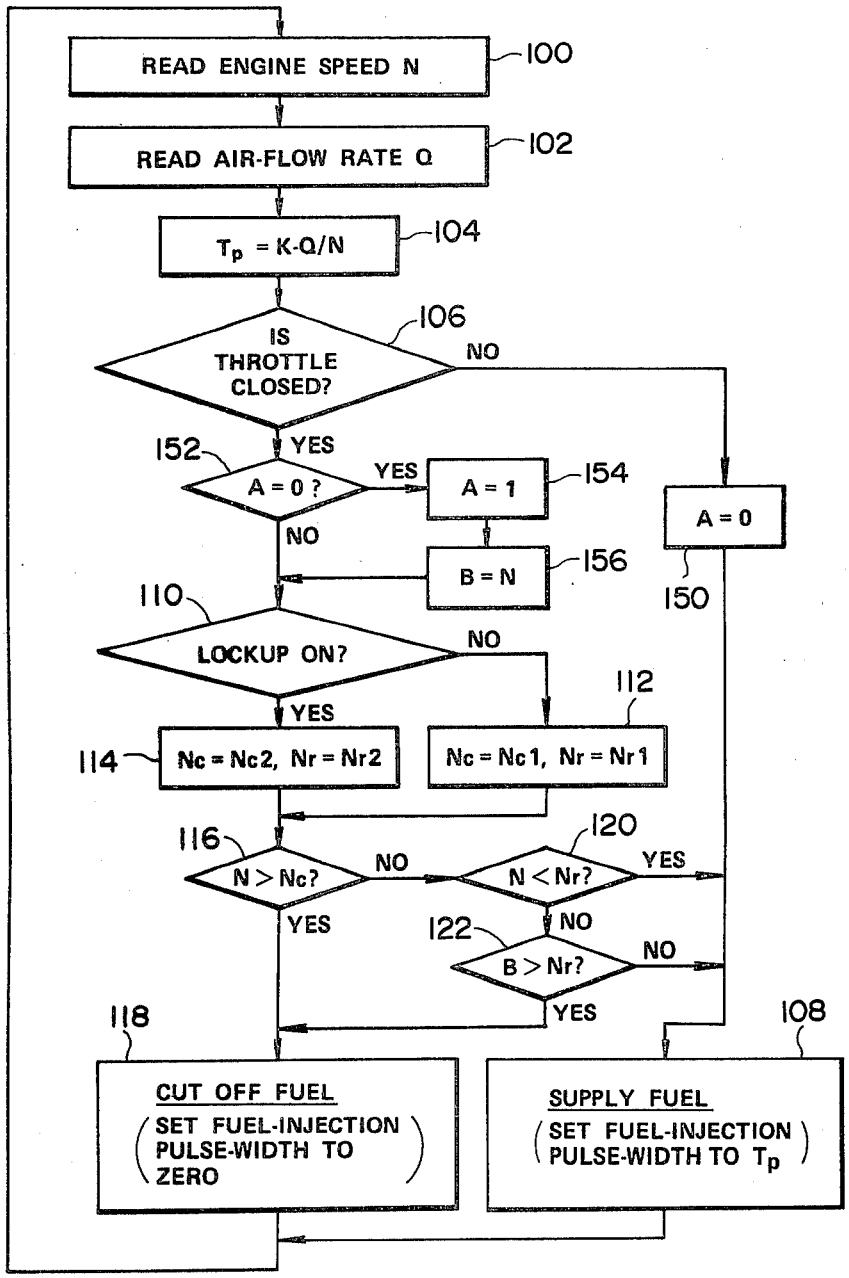
FIG. 3 is an alternative flowchart of operation of the control unit of FIG. 1.

FIG. 3 is an alternative flowchart of operation of the control unit 22. In a first step 100, the control unit 22 reads the current value N of the engine speed derived from the ignition signal $S_4$. In a step 102 subsequent to the step 100, the control unit 22 reads the current value Q of the air-flow rate derived from the signal $S_2$. After the step 102, operation of the control unit 22 proceeds to a step 104 in which the control unit 22 calculates a desired value Tp of the pulse width of the fuel injection signal $S_3$ on the basis of the engine speed value N and the air-flow rate value Q. The desired pulse-width value Tp preferably equals KQ/N, where K is a preset constant. The desired pulse-width value Tp may be corrected in accordance with the temperature of engine coolant and other engine operating conditions.

In a step 106 subsequent to the step 104, the control unit 22 determines whether or not the throttle valve 16 is in its fully-closed position in accordance with the throttle signal $S_1$. When the throttle valve 16 is not in its fully-closed position, operation of the control unit 22 proceeds to a step 150. When the throttle valve 16 is in its fully-closed position, operation of the control unit 22 proceeds to a step 152. In the step 150, the control unit 22 sets a variable A equal to zero, that is, "0". In a step 108 subsequent to the step 150, the control unit 22 sets the actual pulse-width of the fuel injection signal $S_3$ equal to the desired pulse-width value Tp determined in the previous step 104. After the step 108, operation of the control unit 22 returns to the first step 100. As a result, while the throttle valve 16 remains out of its fully-closed position, the supply of fuel to the engine is maintained.

In the step 152, the control unit 22 determines whether or not the variable A is "0". When the variable A is "0", operation of the control unit 22 proceeds to a step 154 in which the control unit 22 sets the variable A equal to one, that is, "1". In a step 156 subsequent to the step 154, the control unit 22 sets a variable B equal to the engine speed value N derived in the previous step 100. After the step 156, operation of the control unit 22 proceeds to a step 110. When the variable A is not "0", operation of the control unit 22 proceeds from the step 152 to the step 110. Since the steps 150, 152, and 154 cooperate to cause operation of the control unit 22 to go from the step 152 to the step 110 by way of the steps 154 and 156 immediately after the throttle valve 16 assumes its fully-closed position, the variable B holds the engine speed value N at the moment of closing of the throttle valve 16.

In the step 110, the control unit 22 determines whether the lockup device is in its rest position or operative position in accordance with the lockup signal $S_5$. When the lockup device is in its rest position, operation of the control unit 22 proceeds to a step 112. When the lockup device is in its operative position, operation of the control unit 22 proceeds to a step 114. In the step 112, the control unit 22 sets the fuel cut-off level Nc and the fuel-supply recovery level Nr equal to the lower values $Nc_1$ and $Nr_1$ respectively. In the step 114, the control unit 22 sets the fuel cut-off level Nc and the fuel-supply recovery level Nr equal to the higher values $Nc_2$ and $Nr_2$ respectively. In this way, the fuel cut-off level Nc and the fuel-supply recovery level Nr depend on the position of the lockup device. The lower values $Nc_1$ and $Nr_1$, and the higher values $Nc_2$ and $Nr_2$ are stored in the ROM of the control unit 22.

After the steps 112 and 114, operation of the control unit 22 proceeds to a step 116 in which the control unit 22 determines whether or not the engine speed value N is higher than the fuel cut-off level Nc. When the engine speed value N is higher than the fuel cut-off level Nc, operation of the control unit 22 proceeds to a step 118 in which the control unit 22 sets the actual pulse-width of the fuel injection signal $S_3$ equal to zero to cut off or interrupt the supply of fuel to the engine 10. After the step 118, operation of the control unit 22 returns to the first step 100. As a result, the fuel cut-off is peformed when the throttle valve 16 is in its fully-closed position and the engine speed value N is higher than the fuel cut-off level Nc. In this case, the fuel cut-off level Nc changes from the lower value $Nc_1$ to the higher value $Nc_2$ when the lockup device shifts from its rest position to its operative position.

When the engine speed value N is not higher than the fuel cut-off level Nc, operation of the control unit 22 proceeds from the step 116 to a step 120 in which the control unit 22 determines whether or not the engine speed value N is lower than the fuel-supply recovery level Nr. When the engine speed value N is lower than the fuel-supply recovery level Nr, operation of the control unit 22 proceeds to the fuel-supply enabling step 108. As a result, the fuel supply is performed when the throttle valve 16 is in its fully-closed position and the engine speed value N is lower than the fuel-supply recovery level Nr. In this case, the fuel-supply recovery level Nr changes from the lower value $Nr_1$ to the higher value $Nr_2$ when the lockup device shifts from its rest position to its operative position.

When the engine speed value N is not lower than the fuel-supply recovery level Nr, operation of the control unit 22 proceeds from the step 120 to a step 122 in which the control unit 22 determines whether or not the variable B is greater than the fuel-supply recovery level Nr. When the variable B is greater than the fuel-supply recovery level Nr, operation of the control unit 22 proceeds to the fuel-supply interrupting step 118. When the variable B is not greater than the fuel-supply recovery level Nr, operation of the control unit 22 proceeds to the fuel-supply enabling step 108. Therefore, in the engine speed range between the fuel-supply recovery level Nr and the fuel cut-off level Nc with the throttle valve 16 being fully-closed, fuel cut-off is enabled if the engine speed value N at the moment of closing of the throttle valve 16 is greater than the fuel-supply recovery level Nr, whereas fuel supply is maintained if this engine speed value N is not greater than the fuel-supply recovery level Nr.

Figure 4:
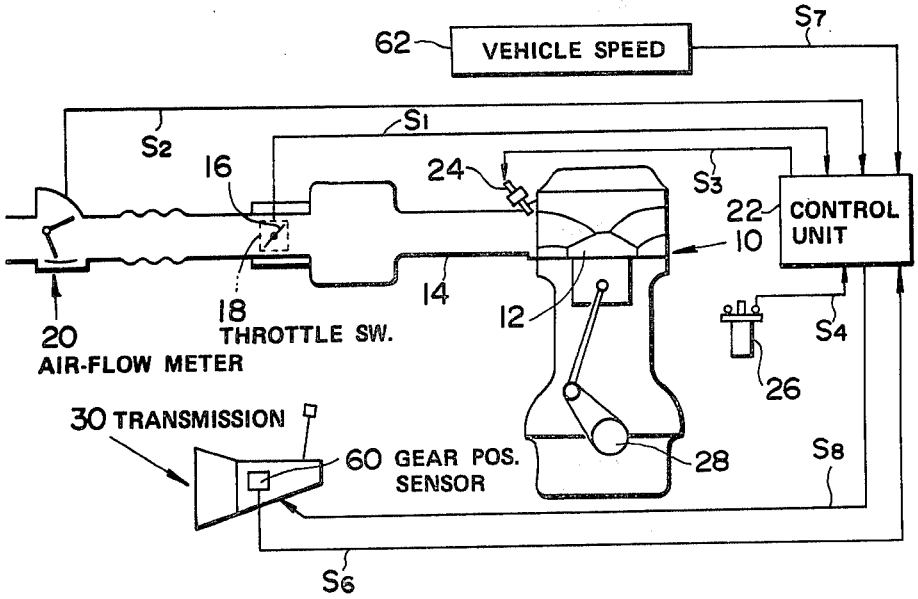
FIG. 4 is a diagram of a fuel cut-off system for an engine coupled to an automatic power transmission with a lockup device according to a second embodiment of this invention.

FIG. 4 diagrammatically illustrates a second embodiment of this invention, which includes a gear position sensor 60 and a vehicle speed sensor 62. The power transmission 30 includes gears with which the position sensor 60 is associated to sense which gear is engaged in the power transmission 30. The position sensor 60 generates a signal $S_6$ indicative of the gear position of the power transmission 30. The I/O circuit of the control unit 22 is electrically connected to the position sensor 60 to receive the gear position signal $S_6$. The speed sensor 62 generates a signal $S_7$ indicative of the speed of the automotive vehicle. The I/O circuit of the control unit 22 is electrically connected to the speed sensor 62 to receive the vehicle speed signal $S_7$.

The control unit 22 generates a lockup control signal $S_8$ in accordance with the engine speed, the gear position of the power transmission 30, and the vehicle speed derived from the signals $S_4$, $S_6$, and $S_7$ respectively. The control signal $S_8$ is outputted via the I/O circuit of the control unit 22, which is electrically connected to the solenoid valve of the lockup device to transmit the control signal $S_8$ to the solenoid valve. The control signal $S_8$ is designed to selectably actuate the solenoid valve.

The lockup detector 32 is eliminated from this second embodiment. Operation of the control unit 22 of this second embodiment differs from that of the first embodiment as described hereinafter. Other parts of this second embodiment are substantially identical to those of the first embodiment, so that description thereof will be omitted.

Figure 5:
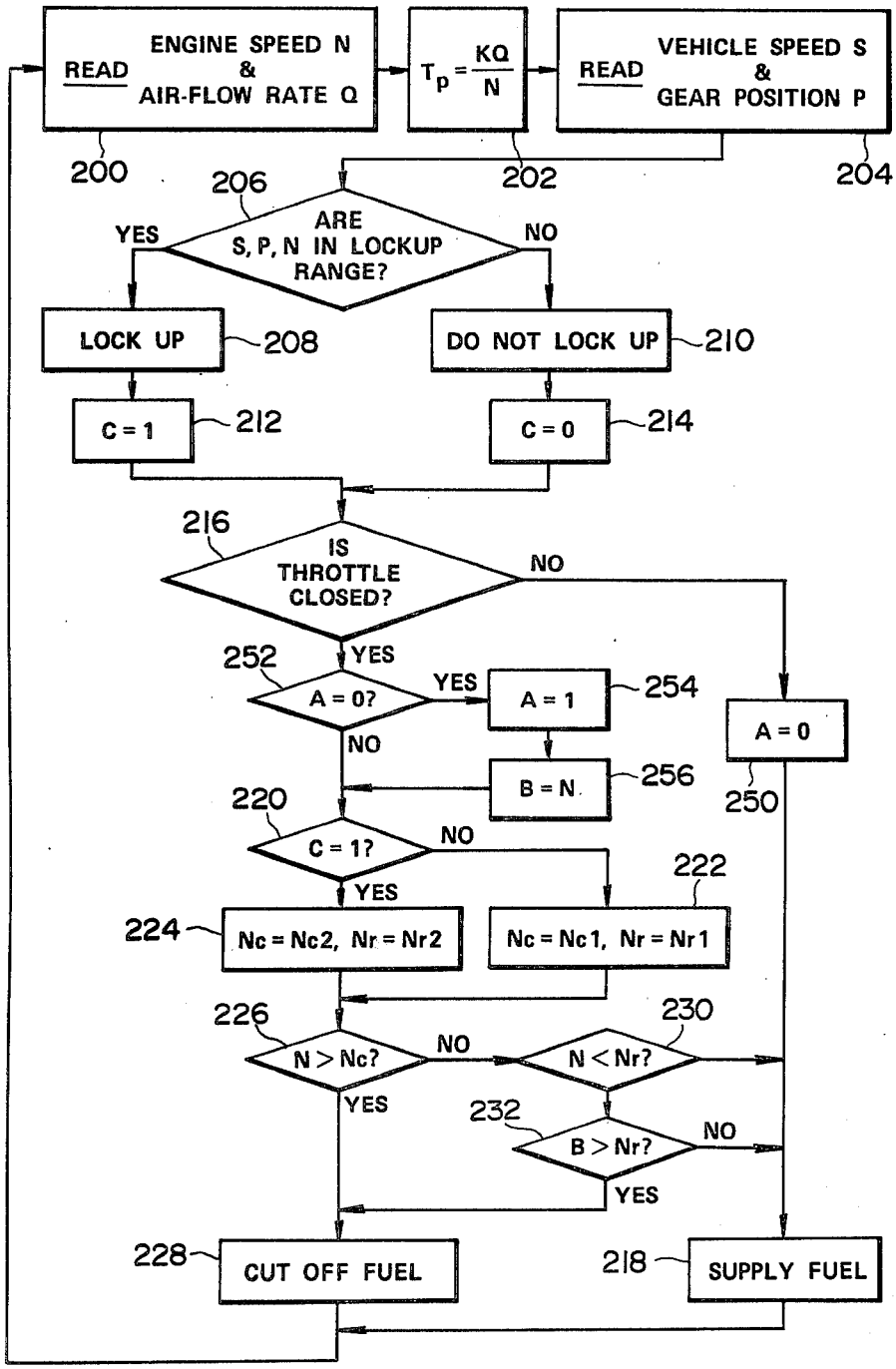
FIG. 5 is a flowchart of operation of the control unit of FIG. 4.

FIG. 5 is a flowchart of operation of the control unit 22 of this second embodiment. In a first step 200, the control unit 22 reads current values N and Q of the engine speed and the air-flow rate derived from the ignition signal $S_4$ and the air-flow rate signal $S_2$ respectively. In a step 202 subsequent to the step 200, the control unit 22 calculates a desired value Tp of the pulse width of the fuel injection signal $S_3$ on the basis of the engine speed value N and the air-flow rate value Q. The desired pulse-width value Tp preferably equals KQ/N, where K is a preset constant.

In a step 204 subsequent to the step 202, the control unit 22 reads current values P and S of the gear position and the vehicle speed derived from the gear position signals $S_6$ and the vehicle speed signal $S_7$ respectively. In a step 206 subsequent to the step 204, the control unit 22 determines whether or not the engine speed value N, the gear position value P, and the vehicle speed value S all lie within a predetermined lockup range. When the values N, P, and S are in the lockup range, operation of the control unit 22 proceeds to a step 208. When the values N, P, and S are out of the lockup range, operation of the control unit 22 proceeds to a step 210. In the step 208, the control unit 22 sets the level of the lockup control signal $S_8$ to a first value by which the lockup device is actuated to its operative position. As a result, when the values N, P, and S are in the lockup range, the lockup device is in its operative position. Specifically, when the engine speed value N is higher than the lockup reference level $N_L$ defining part of the lockup range, the lockup device can be in its operative position. In a step 212 subsequent to the step 208, the control unit 22 sets a variable C equal to one, that is, "1". In the step 210, the control unit 22 sets the level of the lockup control signal $S_8$ to a second value by which the lockup device is actuated to its rest position. As a result, when the values N, P, and S are out of the lockup range, the lockup device is in its rest position. Specifically, when the engine speed value N is not higher than the lockup reference level $N_L$, the lockup device remains in its rest position. In a step 214 subsequent to the step 210, the control unit 22 sets the variable C equal to zero, that is, "0". The variable C indicates the position of the lockup device. Specifically, when the lockup device is in its operative position, the variable C is "1". When the lockup device is in its rest position, the variable C is "0".

After the steps 212 and 214, operation of the control unit 22 proceeds to a step 216 in which the control unit 22 determines whether or not the throttle valve 16 is in its fully-closed position in accordance with the throttle signal $S_1$. When the throttle valve 16 is not in its fully-closed position, operation of the control unit 22 proceeds to a step 250. When the throttle valve 16 is in its fully-closed position, operation of the control unit 22 proceeds to a step 252. In the step 250, the control unit 22 sets a variable A equal to zero, that is, "0". In a step 218 subsequent to the step 250, the control unit 22 sets the actual pulse-width of the fuel injection signal $S_3$ equal to the desired pulse-width value Tp determined in the previous step 202. After the step 218, operation of the control unit 22 returns to the first step 200. As a result, while the throttle valve 16 remains out of its fully-closed position, the supply of fuel to the engine is maintained.

In the step 252, the control unit 22 determines whether or not the variable A is "0". When the variable A is "0", operation of the control unit 22 proceeds to a step 254 in which the control unit 22 sets the variable A equal to one, that is, "1". In a step 256 subsequent to the step 254, the control unit 22 sets a variable B equal to the engine speed value N derived in the previous step 200. After the step 256, operation of the control unit 22 proceeds to a step 220. When the variable A is not "0", operation of the control unit 22 proceeds from the step 252 to the step 220.

In the step 220, the control unit 22 determines whether or not the variable C is "1", that is, whether or not the lockup device is in its operative position. When the variable C is not "1", that is, when the lockup device is in its rest position, operation of the control unit 22 proceeds to a step 222. When the variable C is "1", that is, when the lockup device is in its operative position, operation of the control unit 22 proceeds to a step 224. In the step 222, the control unit 22 sets the fuel cut-off level Nc and the fuel-supply recovery level Nr equal to the lower values $Nc_1$ and $Nr_1$ respectively. In the step 224, the control unit 22 sets the fuel cut-off level Nc and the fuel-supply recovery level Nr equal to the higher values $Nc_2$ and $Nr_2$ respectively. In this way, the fuel cut-off level Nc and the fuel-supply recovery level Nr depend on the position of the lockup device. The lower values $Nc_1$ and $Nr_1$, and the higher values $Nc_2$ and $Nr_2$ are stored in the ROM of the control unit 22. The values of these parameters $Nc_1$, $Nr_1$, $Nc_2$, and $Nr_2$, and the lockup reference level $N_L$ are similar to those of the first embodiment.

After the steps 222 and 224, operation of the control unit 22 proceeds to a step 226 in which the control unit 22 determines whether or not the engine speed value N is higher than the fuel cut-off level Nc. When the engine speed value N is higher than the fuel cut-off level Nc, operation of the control unit 22 proceeds to a step 228 in which the control unit 22 sets the actual pulse-width of the fuel injection signal $S_3$ to zero to cut off or interrupt the supply of fuel to the engine 10. After the step 228, operation of the control unit 22 returns to the first step 200. As a result, the fuel cut-off is performed when the throttle valve 16 is in its fully-closed position and the engine speed value N is higher than the fuel cut-off level Nc. In this case, the fuel cut-off level Nc changes from the lower value $Nc_1$ to the higher value $Nc_2$ when the lockup device shifts from its rest position to its operative position.

When the engine speed value N is not higher than the fuel cut-off level Nc, operation of the control unit 22 proceeds from the step 226 to a step 230 in which the control unit 22 determines whether or not the engine speed value N is lower than the fuel-supply recovery level Nr. When the engine speed value N is lower than the fuel-supply recovery level Nr, operation of the control unit 22 proceeds to the fuel-supply enabling step 218. As a result, the fuel supply is performed when the throttle valve 16 is in its fully-closed position and the engine speed value N is lower than the fuel-supply recovery level Nr. In this case, the fuel-supply recovery level Nr changes from the lower value $Nr_1$ to the higher value $Nr_2$ when the lockup device shifts from its rest position to its operative position.

When the engine speed value N is not lower than the fuel-supply recovery level Nr, operation of the control unit 22 proceeds from the step 230 to a step 232 in which the control unit 22 determines whether or not the variable B is greater than the fuel-supply recovery level Nr. When the variable B is greater than the fuel-supply recovery level Nr, operation of the control unit 22 proceeds to the fuel-supply interrupting step 228. When the variable B is not greater than the fuel-supply recovery level Nr, operation of the control unit 22 proceeds to the fuel-supply enabling step 218. Therefore, in the engine speed range between the fuel-supply recovery level Nr and the fuel cut-off level Nc with the throttle valve 16 being fully-closed, fuel cut-off is enabled if the engine speed valve N at the moment of closing of the throttle valve 16 is greater than the fuel-supply recovery level Nr, whereas fuel supply is maintained if this engine speed value N is not greater than the fuel-supply recovery level Nr.

What is claimed is:

1. A fuel cut-off system for an engine coupled to an automatic power transmission having a lockup device changeable between an operative position and a rest position, the lockup device being responsive to the speed of the engine such that the lockup device is in the operative position when the engine speed is higher than a preset lockup reference level and is in the rest position when the engine speed is not higher than the lockup reference level, the system comprising:

(a) means for sensing when the engine is required to decelerate and generating a deceleration signal indicative thereof;

(b) means for sensing the speed of the engine and generating a speed signal indicative thereof;

(c) fuel-control means, responsive to the deceleration signal and the speed signal, for supplying fuel to the engine when the engine is required to decelerate and the engine speed is lower than an adjustable fuel-supply control level, and for interrupting the supply of fuel to the engine when the engine is required to decelerate and the engine speed is not lower than the fuel-supply control level;

(d) means for sensing whether the lockup device is in the operative position or in the rest position and generating a lockup signal indicative thereof; and (e) means, responsive to the lockup signal and associated with the fuel-control means, for setting the fuel-supply control level equal to a first preset value when the lockup device is in the rest position and setting the fuel-supply control level equal to a second preset value when the lockup device is in the operative position, the second value being greater than the first value and the lockup reference level.

2. The system of claim 1, wherein the first value is smaller than the lockup reference level.

3. A fuel cut-off system for an engine coupled to an automatic power transmission having a lockup device changeable between an operative position and a rest position, the system comprising:

(a) means for sensing when the engine is required to decelerate and generating a deceleration signal indicative thereof;

(b) means for sensing the speed of the engine and generating a speed signal indicative thereof;

(c) fuel-control means, responsive to the deceleration signal and the speed signal, for supplying fuel to the engine when the engine is required to decelerate and the engine speed is lower than an adjustable fuel-supply control level, and for interrupting the supply of fuel to the engine when the engine is required to decelerate and the engine speed is not lower than the fuel-supply control level;

(d) lockup means, responsive to the speed signal and associated with the lockup device, for setting the lockup device in the operative position when the engine speed is higher than a preset lockup reference level and setting the lockup device in the rest position when the engine speed is not higher than the lockup reference level; and (e) level-adjustment means, associated with the fuel-control means and the lockup means, for setting the fuel-supply control level equal to a first preset value when the lockup device is in the rest position, and for setting the fuel-supply control level equal to a second preset value when the lockup device is in the operative position, the second value being greater than the first value and the lockup reference level.

4. The system of claim 3, wherein the first value is smaller than the lockup reference level.

5. The system of claim 3, wherein the fuel-control means, the lockup means, and the level-adjustment means comprise a common microcomputer system.

* * * * *